US009613629B2

(12) United States Patent
Faure et al.

(10) Patent No.: US 9,613,629 B2
(45) Date of Patent: Apr. 4, 2017

(54) CORRECTION OF FRAME LOSS DURING SIGNAL DECODING

(71) Applicant: ORANGE, Paris (FR)

(72) Inventors: Julien Faure, Ploubezre (FR); Stephane Ragot, Lannion (FR)

(73) Assignee: Orange, Paris (FR)

( * ) Notice: Subject to any disclaimer, the term of this patent is extended or adjusted under 35 U.S.C. 154(b) by 0 days.

(21) Appl. No.: 14/764,422

(22) PCT Filed: Jan. 30, 2014

(86) PCT No.: PCT/FR2014/050166
§ 371 (c)(1),
(2) Date: Jul. 29, 2015

(87) PCT Pub. No.: WO2014/118468
PCT Pub. Date: Aug. 7, 2014

(65) Prior Publication Data

US 2015/0371647 A1 Dec. 24, 2015

(30) Foreign Application Priority Data

Jan. 31, 2013 (FR) ..... 13 50845

(51) Int. Cl.
*G10L 19/02* (2013.01)
*G10L 19/005* (2013.01)
(Continued)

(52) U.S. Cl.
CPC ..... *G10L 19/02* (2013.01); *G10L 19/005* (2013.01); *G10L 19/06* (2013.01); *G10L 19/12* (2013.01); *G10L 2019/0016* (2013.01)

(58) Field of Classification Search
CPC ..... G10L 19/02; G10L 19/12; G10L 19/06; G10L 19/005; G10L 19/093; G10L 2019/0016
(Continued)

(56) References Cited

U.S. PATENT DOCUMENTS 6,138,089 A * 10/2000 Guberman ..... G10L 19/02 704/207
7,272,556 B1 * 9/2007 Aguilar ..... G10L 19/093 704/201
(Continued)

OTHER PUBLICATIONS

International Telecommunication Union, "Pulse code modulation (PCM) of voice frequencies; Appendix I: A high quality low-complexity algorithm for packet loss concealment with G.711," ITU-T Recommendation, No. G.711, Appendix I, Geneva, CH, pp. 1-26 (Sep. 1999).
(Continued)

*Primary Examiner* — Marcellus Augustin
(74) *Attorney, Agent, or Firm* — Drinker Biddle & Reath LLP

(57) ABSTRACT

A signal processing device, media, and method are provided, where a signal comprises a succession of samples distributed in successive frames. The processing is implemented during decoding of such a signal in order to replace at least one signal frame lost in decoding, and comprising in particular: a) searching, in a valid signal available to the decoder, for a signal segment of length corresponding to a period set as a function of the valid signal; b) analyzing a spectrum of the segment in order to determine spectral components of the segment; and c) synthesizing at least one replacement frame for the lost frame by construction of a synthesized signal from at least a portion of the spectral components.

14 Claims, 5 Drawing Sheets

(51) Int. Cl.
*G10L 19/06* (2013.01)
*G10L 19/12* (2013.01)
*G10L 19/00* (2013.01)

(58) Field of Classification Search
USPC ..... 704/200, 200.1, 203, 207–224, 236
See application file for complete search history.

(56) References Cited

U.S. PATENT DOCUMENTS 7,302,064 B2 * 11/2007 Causevic ..... G06K 9/00516
381/94.1
2001/0051873 A1 * 12/2001 Das ..... G10L 19/0204
704/268
2010/0318349 A1 * 12/2010 Kovesi ..... G10L 19/005
704/207
2012/0265534 A1 * 10/2012 Coorman ..... G10L 13/033
704/265

OTHER PUBLICATIONS

Parikh et al., "Frame Erasure Concealment Using Sinusoidal Analysis-Synthesis and Its Application to MDCT-Based Codecs," 2000 IEEE International Conference on Acoustics, Speech, and Signal Processing, 2000, ICASSP'00, Jun. 5-9, 2000, Piscataway, NJ, USA, IEEE, vol. 2, pp. 905-908 (Jun. 5, 2000).

* cited by examiner

FIG. 5
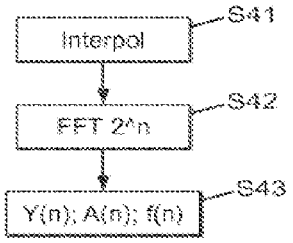
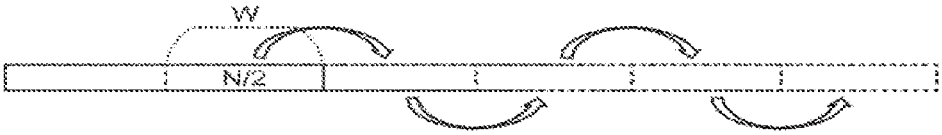
FIG. 6
FIG. 8
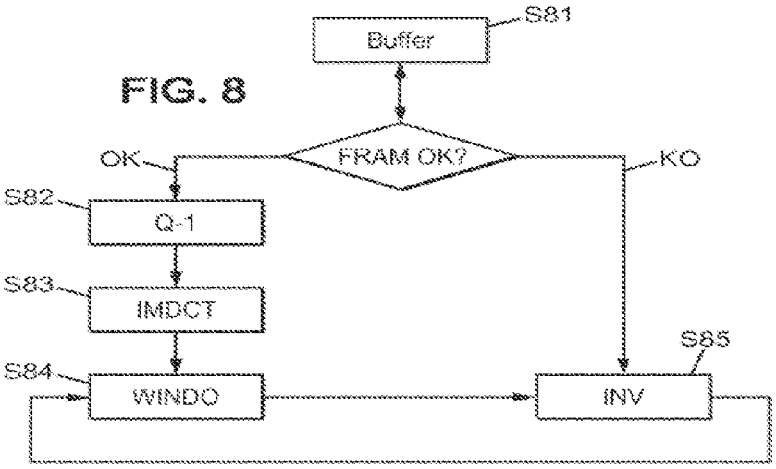

CORRECTION OF FRAME LOSS DURING SIGNAL DECODING

CROSS-REFERENCE TO RELATED APPLICATIONS

This application is the U.S. national phase of the International Patent Application No. PCT/FR2014/050166 filed Jan. 30, 2014, which claims the benefit of French Application No. 13 50845 filed Jan. 31, 2013, the entire content of which is incorporated herein by reference.

FIELD

The present invention relates to a signal correction, especially in the decoder, in case of frame loss by this decoder on receiving the signal.

BACKGROUND

The signal has the form of a succession of samples, broken into successive frames and "frame" is understood to mean a signal segment composed of several samples (an implementation where one frame comprises one single sample is possible if the signal has the form of a succession of samples, as in for example the codecs according to the ITU-T G.711 recommendation).

The invention is in the digital signal processing field, in particular but not exclusively, in the field of coding/decoding an audio signal. Frame losses occur when communication (either by real-time transmission, or by storage for subsequent transmission) using a coder and a decoder is disrupted by channel conditions (e.g. because of radio problems, access network congestion, etc.).

In this case, the decoder uses frame loss correction (or "concealment") mechanisms in order to attempt to substitute a reconstructed signal for the missing signal by using information available within the decoder (for example, the already decoded signal or parameters received in preceding frames). With this technique, good service quality can be maintained despite degraded channel performance.

Frame loss correction techniques are most often very dependent on the type of coding use.

In the case of the coding of a speech signal based on CELP ("Code Excited Linear Prediction") type technologies, the frame loss correction makes use in particular of the CELP model. For example, in a coding according to the ITU-T G.722.2 recommendation, the solution for replacing a lost frame (or a "packet") consists of extending the use of a long-term gain prediction by the attenuator and also extending the use of each ISF ("Immittance Spectral Frequency") parameter by making them tend towards their respective averages. The pitch of the speech signal (parameter designated "LTP lag") is also repeated. Additionally, random values for parameters characterizing the "innovation" (the excitation in the CELP coding) are supplied to the decoder.

It should be noted already that the application of this type of method for transform coding or PCM or ADPCM type waveform coding requires a CELP type parametric analysis in the decoder of the signal passed which introduces an additional complexity.

In the ITU-T G.711 recommendation corresponding to a waveform coder, an informative example of frame loss correction processing (given in Appendix I of the text of this recommendation) consists of finding a pitch period in the already decoded speech signal and repeating the last pitch period by recovery-addition ("overlap-add") between the already decoded signal and the repeated signal (reconstructed by concealment). With this processing, the audio artifacts can be "smoothed" but require an additional delay in the decoder (delay corresponding to the recovery time).

The most used technique for replacing frame loss in the case of coding by transformation consists of repeating the spectrum decoded in the last frame received. For example, in the case of coding according to the ITU-T G.722.1 recommendation, the MLT ("modified lapped transform") transform, equivalent to a modified discrete cosine transform (MDCT) with a 50% recovery and sinusoidal shaped analysis/synthesis windows, serves to provide a sufficiently slow transition between the last lost frame and the repeated frame for smoothing the artifacts related to the simple repetition of the spectrum; typically, the repeated spectrum is set to zero if more than one frame is a lost.

Advantageously, this concealment method does not require additional delay because it makes use of the recovery-addition between the reconstructed signal and the past signal in order to make a sort of "crossfade" (with temporal aliasing due to the MLT transform). It represents a technique with very low resource cost.

However, it has a defect related to the temporal inconsistency between the signal right before the loss of frame and the repeated signal. The result of this is a phase discontinuity (or inconsistency) which can produce significant audio artifacts if the recovery time between the signals associated with two frames is reduced (as is the case in particular when MDCT frames referred to as "short delay" are used). The short-term recovery situation is illustrated in FIG. 1B in the case of a short delay MLT transform, in comparison with the usual situation from FIG. 1A in which long sine windows are used according to the G.722.1 recommendation (thus providing a long recovery time ZRA with a very progressive modulation). It appears that a modulation by a short delay window produces a phase offset which is which is audible because of the short recovery zone ZRB, as shown in FIG. 1B.

In this case, even though a solution combining a pitch search (case of decoding according to recommendation G.711 Appendix I) and a recovery-addition produced by the window of an MDCT transform would be implemented, it would not be sufficient for eliminating the audio artifacts related in particular to the phase shift between the frequency components.

SUMMARY

The present invention aims to improve the situation.

For this purpose it proposes a method for processing a signal comprising a succession of samples distributed in successive frames, where the method is implemented during a decoding of said signal in order to replace at least one signal frame lost in decoding. In particular, the method comprises the steps:

a) search, in a valid signal available to the decoder, for a signal segment of length corresponding to a period set as a function of said valid signal;

b) analyze spectrum of the segment in order to determine spectral components of the segment;

c) synthesize at least one replacement frame for the lost frame, by construction of a synthesized signal from at least a portion of the spectral components.

Here a "frame" is understood to be a block of at least one sample. In most codecs, these frames are constructed of several samples. However, in some codecs especially PCM ("Pulse Code Modulation") type, for example according to the G.711 recommendation, the signal is constructed simply of a succession of samples (one "frame" in the sense of the invention then comprises only one sample). The invention can then also be applied to this type of codec.

For example, the valid signal could be constructed from the last valid frames received before the frame loss. One or more following valid frames, received after the lost frame could also be used (although such an implementation leads to a decoding delay). The samples from the valid signal which are used can be directly those from the frames, and could be those which correspond to the memory from the transform and which typically contain aliasing in the case of MLT or MDCT type decoding by transform with recovery.

The invention provides an advantageous solution to the correction of frame loss, in particular in the case where an additional decoder delay is prohibited, for example when a transformed decoder is used with windows that do not have a sufficiently large overlap between the substitution signal and the signal coming from temporal unfolding (typical case for short delay windows for MDCT or MLT as shown in FIG. 1*b*). The invention has a particular advantage for recovery, because of the use of spectral components over the last valid frames received in order to construct a synthesized signal comprising spectral coloration from these last valid frames. Nonetheless, the invention of course applies to any type of coding/decoding (by transform, CELP, PCM or other).

In an embodiment, the method comprises a search, by correlation in the valid signal, for one repetition period, where the length of the aforementioned segment then comprises at least one repetition period.

Such a "repetition period" corresponds for example to a pitch period in the case of a spoken voice signal (inverse of the fundamental frequency of the signal). Nonetheless, the signal can also come from a musical signal for example, having an overall tonality with which is associated a fundamental frequency and also a fundamental period which could correspond to the aforementioned repetition period.

A repetition period search for the period related to the tonality of the signal could be used for example. For example, a first memory buffer can be constructed from the last several samples validly received and a second larger sized buffer can be searched by correlation for some samples from the second buffer which best correspond in their succession to those from the first buffer. The temporal offset between these samples identified from the second buffer and those from the first buffer can constitute a repetition period or a multiple of this period (according to the fineness of the correlation search). It should be noted that by taking a multiple of the repetition period the implementation of the invention is not degraded because in this case the spectral analysis is simply done over a length covering several periods instead of just one, which contributes to increasing the fineness of the analysis.

Thus, the signal length over which the spectral analysis is done can be determined as being:

- A length corresponding to a repetition period (if a tonality of the signal is clearly identifiable);
- A length corresponding to several repetition periods (pitch cycles for example), if the correlation gives a first correlation result greater than a predetermined threshold, as explained in the operational embodiment which follows
- An arbitrary signal length (for example some tens of samples), if such a tonality is not identifiable (signal composed essentially of noise).

In a specific embodiment, the aforementioned repetition period corresponds to a length for which the correlation exceeds a preset threshold value. Thus, in this implementation, the length of the signal is identified once the correlation exceeds a predetermined threshold value for this time. The length thus identified corresponds to one or more periods associated with the frequency of the aforementioned overall tonality. With such an implementation the complexity of the search by correlation can advantageously be limited (for example by setting a 60 or 70% correlation threshold), even if in reality not a single, but several pitch periods (for example between two and five pitch periods) are detected. First, the complexity of the correlation search is then lower. Second, the spectral analysis over several periods is finer and the resulting spectral components are more finely analyzed.

As for obtaining spectral components by segment analysis (for example by Fast Fourier Transform or FFT), the method additionally comprises a determination of the respective phases associated with these spectral components and the construction of the synthesized signal then comprises the phases of the spectral components. The construction of the signal then incorporates these phases, as will be seen later, for an optimization of the connection of the synthesized signal to the last valid frames and, in most natural cases, the following valid frames.

In a specific implementation also, the method additionally comprises a determination of respective amplitudes associated with the spectral components and construction of the synthesized signal comprises these amplitudes of the spectral components (for their consideration in the construction of the synthesized signal).

In a specific implementation, it is possible to select components coming from the analysis for the construction of the synthesized signal. For example, in an implementation where the method comprises a determination of respective amplitudes associated with the spectral components, the highest amplitude spectral components can be those selected for the construction of the synthesized signal. Thus, as a supplement or a variant, those whose amplitude forms a peak in the frequency spectrum can be selected.

In the case where a single part of the spectral components is selected, in a specific implementation, noise can be added to the synthesized signal in order to compensate for a loss of energy relative to spectral components not selected for construction of the synthesized signal.

In an implementation, the aforementioned noise is obtained by a (temporally) weighted residue between the signal from the segment and the synthesized signal. It can for example be weighted by recovery windows, as in the context of a coding/decoding by transformation with recovery.

The spectral analysis of the segment comprises a sinusoidal analysis by Fast Fourier Transform (FFT) preferably of length 2^k, where k is greater than or equal to $\log_2(P)$, where P is the number of samples in the signal segment. Such an implementation serves to reduce the processing complexity, as detailed later. It should be noted that as a possible alternative to the FFT transform other transforms are possible, for example Modulated Complex Lapped Transform (MCLT) type transform.

In particular, the spectral analysis step can provide:

- An interpolation of the samples from the segment in order to obtain a second segment comprising 2^ceil($\log_2(P)$) samples, where ceil(x) is the integer greater than or equal to x;

A calculation of the Fourier transform of the second segment; and

After determination of the spectral components, identification of the frequencies associated with the components, and construction of the synthesized signal by resampling with modification of said frequencies as a function of the resampling.

The present invention has an advantageous but in no way limiting application in the context of decoding by transform with recovery. In such a context, it can be advantageous that the synthesized signal be constructed (repeated) over a length of at least two frames, so as to also cover the parts comprising a temporal aliasing beyond a single frame.

In a specific implementation, the synthesized signal can be constructed over two frame lengths and also an additional length corresponding to a delay introduced by a resampling filter (in particular in the implementation presented above and where resampling is provided).

It can be advantageous to manage a jitter buffer in some implementations. In the case where frame loss correction is done jointly with jitter buffer management, the invention can then be he applied in these conditions by adapting the length of the synthesized signal.

In an implementation, the method additionally comprises a separation of the signal coming from the valid frame(s) into a high-frequency band and a low-frequency band and the spectral components are selected in the low-frequency band. With such an implementation, the complexity of the processing can be limited essentially to the low-frequency band since the high frequencies contribute little spectral richness to the synthesized signal and can be repeated more simply.

In this implementation the replacement frame can be synthesized by the addition of:

a first signal constructed from spectral components selected in the low-frequency band, and a second signal coming from the filtering in the high-frequency band, where the second signal was obtained by successive duplication of at least one valid half-frame and the temporally folded version thereof.

The present invention also targets a computer program comprising instructions for implementing the method (for example, the general schematic from FIG. 2 can be a general block diagram and possibly in certain embodiments specific block diagrams from FIGS. 5 and/or 8).

The present invention also covers a device for decoding a signal comprising a succession of samples distributed in successive frames, where the device comprises means for replacing at least one lost signal frame, comprising:

a) means to search, in a valid signal available to the decoder, for a signal segment of length corresponding to a period set as a function of said valid signal;

b) means to analyze the spectrum of the segment in order to determine spectral components of the segment;

c) means to synthesize at least one replacement frame for the lost frame, by construction of a synthesized signal from at least a portion of the spectral components.

Such a device can take the hardware form for example of a processor and possibly working memory typically in a communications terminal.

BRIEF DESCRIPTION OF THE DRAWINGS

Other advantages and features of the invention will appear upon reading the detailed description below of examples of implementation of the invention and examining the drawings in which:

FIG. 5 shows an embodiment of a spectral analysis of the signal segment.

FIG. 6 shows an implementation example for copying, in the high frequencies, a valid frame replacing several lost frames.

FIG. 8 shows an example of application of the method in the meaning of the present invention to decoding a signal.

DETAILED DESCRIPTION

Figure 1A:
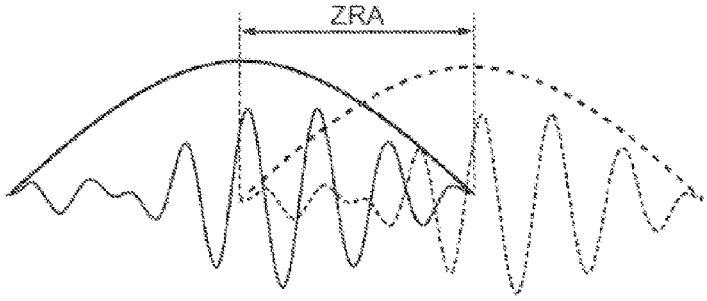
FIG. 1A shows a recovery with conventional windows in connection with an MLT transform.
Figure 1B:
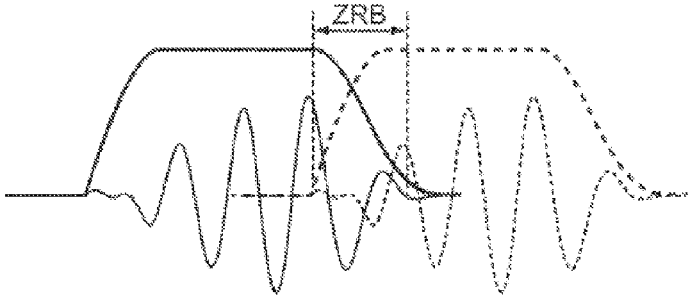
FIG. 1B shows a recovery with small delay windows, in comparison with the representation from FIG. 1A.
Figure 2:
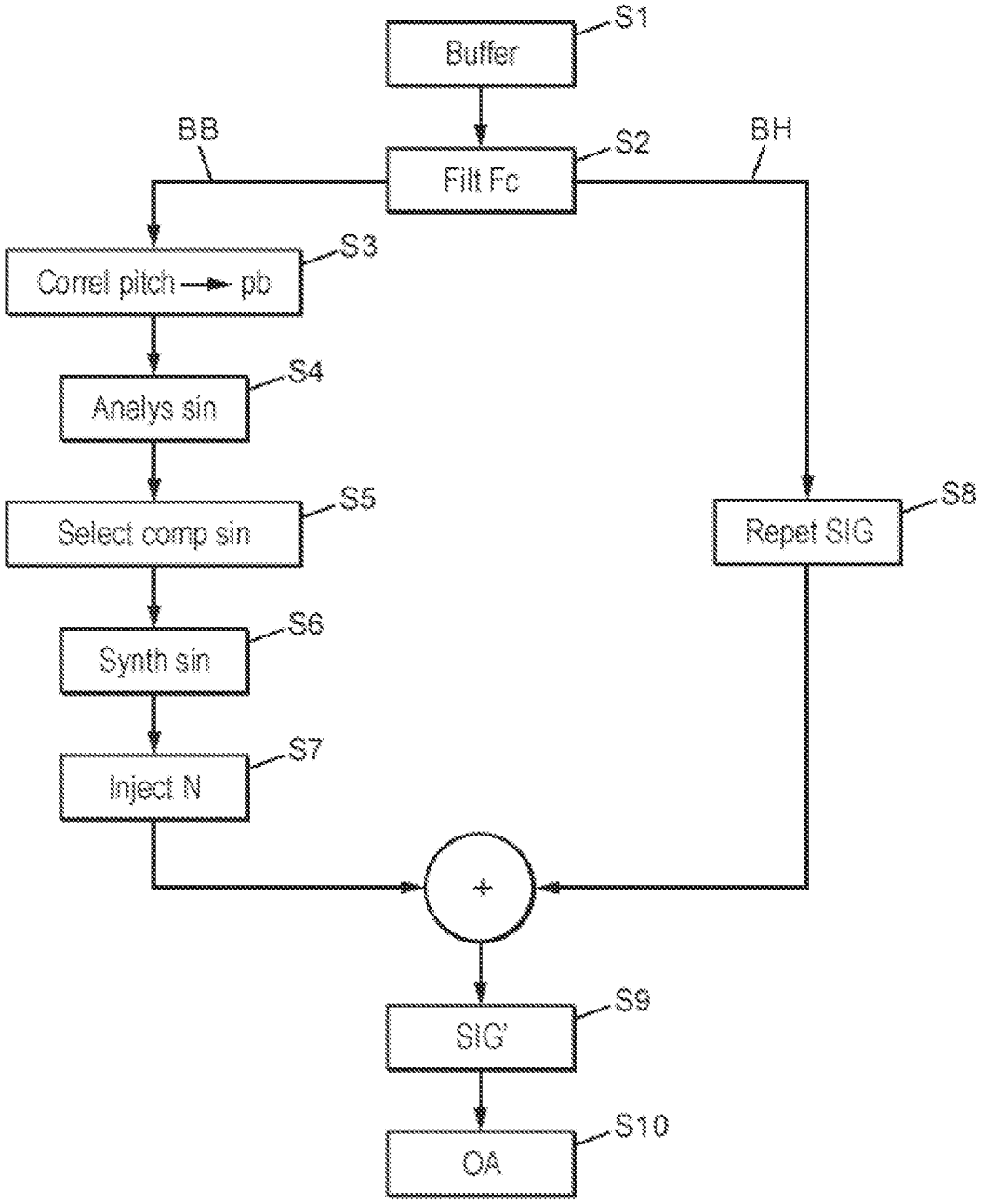
FIG. 2 shows an example of general processing in the meaning of the invention.

Processing in the meaning of the invention is shown in FIG. 2. It is implemented at a decoder. The decoder can be of any type, since overall the processing is independent of the nature of the coding/decoding. In the example described, the processing applies to a received audio signal. It can however apply more generally to any type of signal analyzed by temporal windowing and transformation, with a harmonization to be provided with one or more replacement frames during a synthesis by recovery-addition.

During the first processing step S1 from FIG. 2, N audio samples are stored successively in the memory buffer (for example FIFO type). The audio buffer b(n) can thus be constructed for example from 47 ms of signal, which is for example 2.35=47/20 audio frames of 20 ms each, at a sampling frequency Fs given, for example by Fs=32 kHz. These samples correspond to samples which are already decoded and therefore accessible at the time of frame(s) loss correction processing. If this first sample to be synthesized is the sample with time index N (for one or more consecutive lost frames), the audio buffer b(n) then corresponds to the N preceding samples with time indices 0 to N−1. In the case of a coder by transform, the audio buffer corresponds to the samples already decoded in the past frame (and therefore un-modifiable). If it is possible to add an additional delay to the decoder (for example of D samples), the buffer may contain only a portion of the samples available to the decoder, leaving for example the last D samples for the recovery-addition (in step S10 from FIG. 2).

At the filtering step S2, the audio buffer b(n) is next separated into two frequency bands: a low-frequency band LFB and a high-frequency band HFB with a frequency separation written Fc, with for example Fc=4 kHz Preferably this filtering does not introduce delay. The size of the previously defined audio buffer corresponds preferentially now to N'=N Fc/Fe with this frequency Fc.

The step S3, applied to the low-frequency band, consists of next seeking a looping point and a segment P corresponding to the fundamental period (or pitch period) within the buffer b(n) resampled with the frequency Fc. For this purpose, in an implementation example, a normalized correlation corr(n) is calculated between:

a target segment from the buffer (reference CIB from FIG. 3) where the size of this segment Ns is included between N'−Ns and N'−1 (for a length of 6 ms for example); and a sliding segment of size Ns which starts at a sample occupying a position between sample 0 and sample Nc (with Nc>N'−Ns; where Nc corresponds for example to a length of 35 ms), where:

$$\mathrm{Corr}(n) = \frac{\sum_{k=0}^{k=Ns} b(n+k)b(N'-Ns+k)}{\sqrt{\sum_{k=0}^{k=Ns} b(n+k)^2 \sum_{k=0}^{k=Ns} b(N'-Ns+k)^2}} \quad n \in [0; Nc]$$

Figure 3:
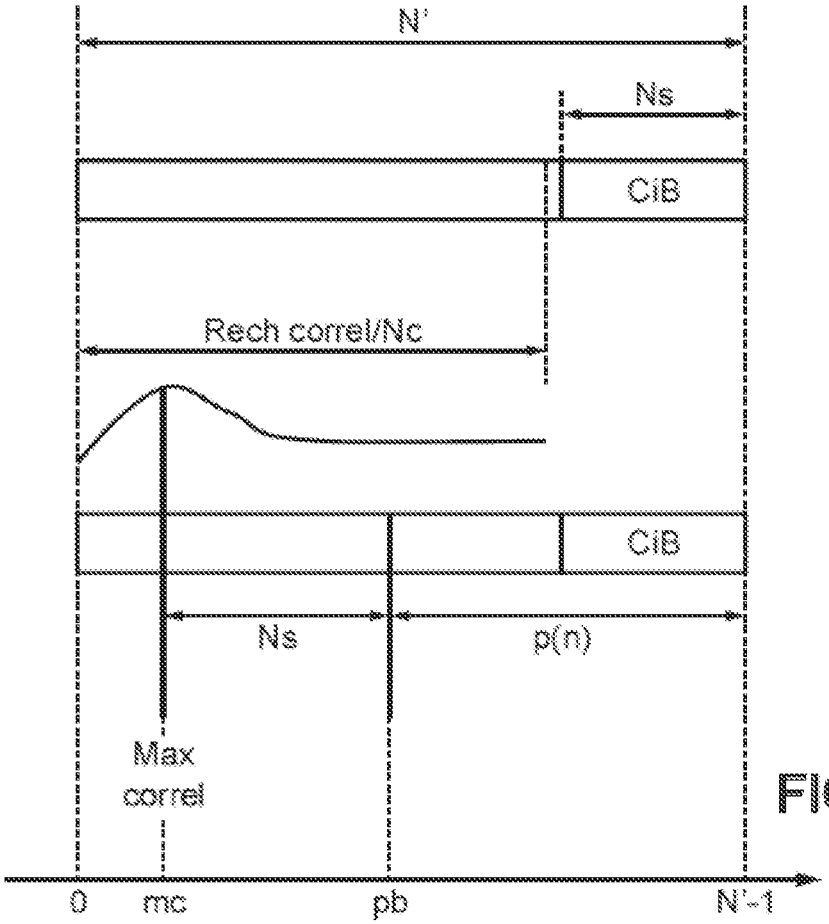
FIG. 3 shows the determination of a signal segment corresponding to a fundamental period.

With reference to FIG. 3, if the maximum correlation is found for the sample with time index n=mc, the looping point with one pitch period, with index n=pb, corresponds to the sample mc+Ns and the segment notated by p(n) which follows on FIG. 3 corresponds to a pitch period of size P=N'−Ns−mc, defined between the samples n=pb and n=N'−1.

The sliding, search segment is prior to the target segment, as shown in FIG. 3. In particular, the first sample from the target segment corresponds to the last sample from the search segment. If the maximum correlation with the target segment CIB is located earlier in the search segment at an index point mc, then at least one pitch period (with the same sinusoid intensity for example) elapses between the time index point mc and the sample with time index mc+P. In the same way at least one pitch period elapses between the sample with index mc+Ns (looping point, index pb) and the last sample from the buffer N'.

A variant of this implementation consists of an autocorrelation on the buffer, amounting to finding an average period P identified in the buffer. In this case, the segment used for the synthesis comprises the last P samples from the buffer. However, an autocorrelation calculation on a long segment can be complex and require more computer resources than a simple correlation of the type described above.

Additionally, another variant of this implementation consists of not necessarily searching for the maximum correlation over the whole search segment, but simply searching for a segment where the correlation with the target segment is greater than the chosen threshold (for example 70%). Such an implementation does not precisely give a single pitch period P (but possibly several successive periods), but nonetheless the complexity associated with the search for a correlation maximum over the full search segment requires as much, or even more resources, than the processing of a long synthesized segment (with several pitch periods).

In the following it will be assumed that a single pitch period P is used for the synthesis of the signal, but it is however appropriate to recall that the principle of the processing applies just as well for a segment extending over several fundamental periods. In terms of precision in the FFT transform and richness of the resulting spectral components, the results turn out to be even better with several pitch periods.

Figure 4:
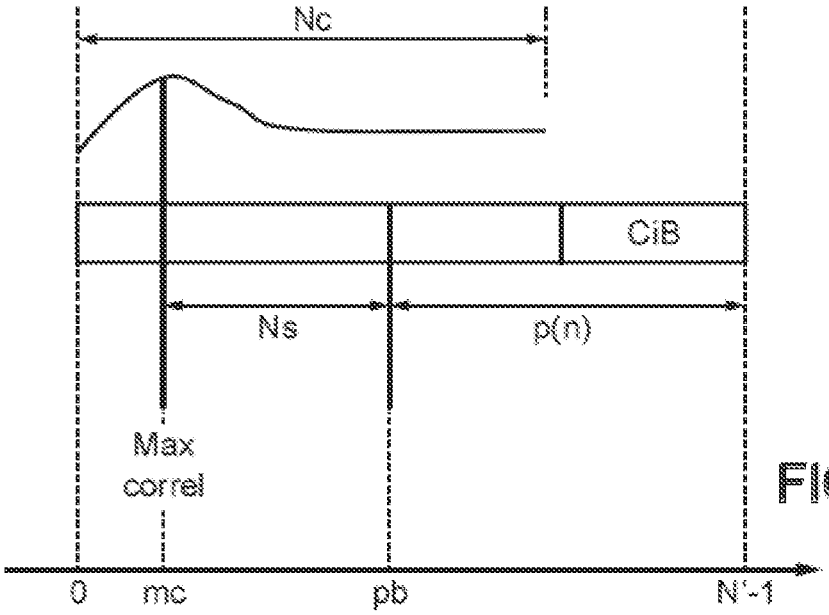
FIG. 4 shows the determination of a signal segment corresponding to a fundamental period, with a correlation search offset in this implementation example.

In the case where transients may be present in the audio signal contained in the buffer (very short duration intensity peaks in the audio signal), it is possible to adapt the correlation search zone, for example by offsetting the correlation search (by making it start typically 20 ms after the beginning of the audio buffer as shown as an example in FIG. 4, or by performing the correlation search in a temporal zone starting after the end of the transient).

The step following S4 consists of decomposing the segment p(n) into a sum of sines. Conventionally decomposing the signal into a sum of sines consists of calculating the discrete Fourier transform (or DFT) of the signal over a time corresponding to the signal length. The frequency, phase and amplitude of each of the sinusoidal components which make up the signal are thus obtained. In a specific embodiment of the invention, for reasons of reduced complexity, this analysis is done with the Fast Fourier Transform FFT, with length 2^k (with k greater than or equal to $\log_2(P)$).

In this specific embodiment, the step S4 is broken down into three operations, with, referring to FIG. 5:

the operation S41 where the samples from the segment p(n) are interpolated so as to obtain a segment p'(n) composed of P' samples with $P'=2^{ceil(log_2(P))}>P$, where ceil(x) is the integer greater than or equal to x (for example and without restriction, one could use linear or even cubic spline type interpolation);

the operation S42 with the calculation of the FFT transform of p'(n): Π(k)=FFT (p'(n)); and the operation S43 in which based on the FFT transform, the phases ϕ(k) and amplitudes A(k) of the sinusoidal components are obtained directly, where the frequencies normalized between 0 and 1 are given by:

$$f(k) = \frac{2kP'}{P^2} \quad k \in \left[0; \frac{P'}{2} - 1\right]$$

In step S5 from FIG. 2, the sinusoidal components are selected so as to keep only the most significant components. In a specific embodiment, the selection of the components amounts to:

first selecting the amplitudes A(k) for which A(k)>A(k−1) and $$A(k) > A(k+1) \quad k \in \left[0; \frac{P'}{2} - 1\right],$$

next selecting among the amplitudes from this first selection the components, for example in order of decreasing amplitude, such that the cumulative amplitude of the selected peaks is at least x % (for example x=70%) of the cumulative amplitude of the half spectrum.

It is also additionally possible to limit the number of components (for example to 20) so as to make the synthesis less complex. Alternatively, a search can be done for a preset number of the largest peaks.

Of course, the method for selecting the spectral components is not limited to the examples presented above. There can be variants. It can in particular be based on any criteria with which to identify the spectral components useful in the synthesis of the signal (for example subjective criteria related to concealment, criteria related to the harmoniousness of the signal, or others).

The following step S6 covers a sinusoidal synthesis. In a sample implementation, it consists of generating a segment s(n) of length at least equal to the size of a lost frame (T). In a specific embodiment, a length equal to two frames (40 ms for example) is generated so as to be able to perform a "cross-fade" type sound mixing (as a transition) between the signal synthesized (by frame loss correction) and the signal decoded from the following valid frame when a frame is again received correctly.

In order to anticipate the resampling of the frame (sample length noted LF), the number of samples to be synthesized can be increased by half of the size of the resampling filter (LF). The synthesized signal s(n) is calculated as a sum of the selected sinusoidal components:

$$s(n) = \sum_{k=0}^{k=K} A(k)\sin(\pi f(k)n + \varphi(k)) \quad n \in \left[0; 2T + \frac{LF}{2}\right]$$

where k is the index of the K components selected in step S5. Several conventional methods are possible for doing this sinusoidal synthesis.

Step S7 from FIG. 2 consists of injecting noise so as to compensate for the energy loss related to the omission of certain frequency components in the low-frequency band. A specific embodiment consists of calculating the residual r(n)=p(n)−s(n) between the corresponding segment at pitch p(n) and the synthesized signal s(n), with: n ϵ [0; P−1].

This residual of size P is repeated until it reaches a size $$2T + \frac{LF}{2},$$

The signal s(n) is next mixed (added with a possible weighting) to the signal r(n).

Of course, the noise generation method (in order to get a natural background noise) is not limited to the previous example and variations are possible. For example, it is also possible to calculate the residual in the frequency domain (by eliminating the spectral components selected from the original spectrum) and getting the background noise by inverse transform.

In parallel, step S8 consists of processing the high-frequency band simply by repeating the signal. For example, it could involve repeating a length of frame T. In a more sophisticated implementation, the synthesis of the HFB is obtained by taking the last T' samples before the frame loss (with for example T'=N/2), and by temporally folding them, and then by repeating them without folding and so on as shown in FIG. 6. Advantageously with such an implementation, audible artifacts can be avoided by placing the beginning and end of frames at the same loudness.

In a specific embodiment, the frame of size T' can be weighted so as to avoid certain artefacts when the contents are particularly energetic in the high-frequency band. The weighting (referenced W in FIG. 6) can for example take the form of a 1 ms sinusoidal half-window at the beginning and end of the frame of length T/2. The successive frames can also overlap.

In a step S9, the signal is synthesized by resampling the low-frequency band at its original frequency Fc and adding it to the signal coming from the repetition from step S8 in the high-frequency band.

Figure 7:
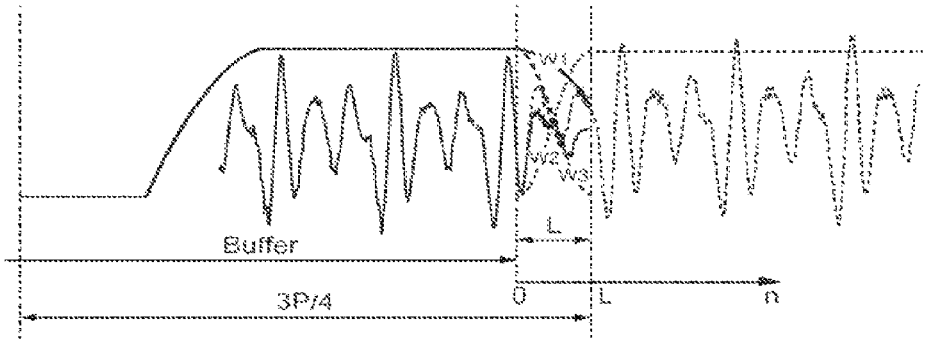
FIG. 7 shows the reconstruction of the signal from the lost frames with weighting by synthetic windows.

In step S10, a recovery-addition is done serving to assure continuity between the signal before the frame loss and the synthesized signal. For example, in the case of coding by low delay transform, the L samples located between the start of the aliased part (remaining aliased part) of the MDCT transform and the three quarters mark of the window (with for example a temporal aliasing axis for the windows as usual in connection with an MDCT transform). With reference to FIG. 7, these samples are already covered by the synthesis window W1 of the MDCT transform. In order to be able to apply a recovery window W2 to them, the samples are divided by the window W1 (which is already known from the decoder), and multiplied by the window W2. The signal S(n) synthesized by the implementation of steps S1 to S9 previously described is thus written:

$$S(n) = L(n)\frac{W3(n)}{W1(n)} + S(n)W2(n) \quad n \in [0; L-1]$$

with for example, and without limitation, recovery functions defined by:

$$W2(n) = \sin\left(\frac{\pi(n+0.5)}{2L}\right)^2$$

and $$W3(n) = 1 - W2(n) \quad n \in [0; L-1]$$

As previously described, if a delay in the decoder is allowed, this delay time can be used for making a recovery with the synthetic part, by using any weighting appropriate for the recovery-addition.

Of course, the present invention is not limited to the embodiment described above; it extends to other variants.

Thus for example, the separation in step S2 into high and low-frequency bands is optional. In an implementation variant, the signal coming from the buffer (step S1) is not separated in two sub-bands and the steps S3 to S10 remain identical to those described above. Nonetheless, the processing of the spectral components only in the low frequencies serves advantageously to limit its complexity.

Figure 9:
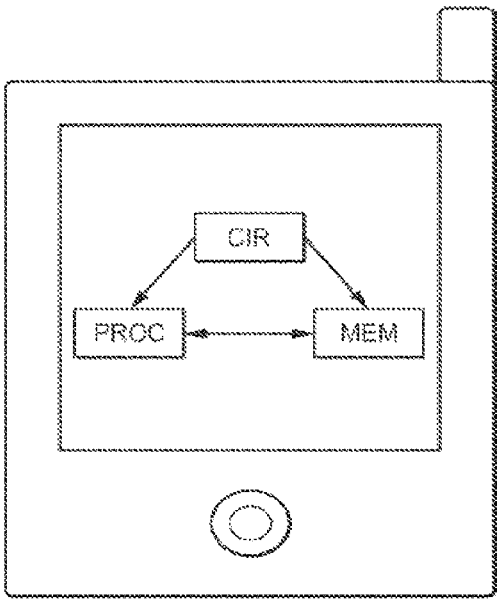
FIG. 9 shows schematically a device comprising means for implementing the method in the meaning of the invention.

The invention can be implemented in a conversational decoder, in the case of a frame loss. Materially, it can be implemented in a decoding circuit, typically in a telephone terminal. For that purpose, such a circuit CIR can comprise or be connected to a processor PROC, as shown in FIG. 9, and can comprise a working memory MEM programmed with computer program instructions according to the invention for executing the above method.

For example, the invention can be implemented in a real-time decoder by transform. With reference to FIG. 8, the decoder sends requests to get an audio frame and a frame buffer (step S81). If the frame is available (OK output from the test), the decoder decodes the frame (S82) so as to get a signal in the transformed domain, implements an inverse transform IMDCT (S83) which then serves to get the "aliased" time samples and then proceeds to a final windowing (by a synthesis window) and recovery step S84 in order to get temporal samples free from aliasing which will then be sent to a digital to analog converter for restitution.

When a frame is missing (KO output from the test), the decoder then uses the already decoded signal and also the "aliased" part from the preceding frame (step S85) in the frame loss correction method in the meaning of the invention.

The invention claimed is:

1. A method for processing a signal comprising a succession of samples distributed in successive frames, the method being implemented during a decoding of said signal in order to replace at least one signal frame lost in decoding, wherein the method comprises:

a) searching, in a valid signal available to the decoder, for a signal segment of a length corresponding to a period set as a function of said valid signal;

b) analyzing a spectrum of the segment in order to determine spectral components of the segment by carrying out steps comprising:

interpolating the samples from the segment in order to obtain a second segment comprising 2^ceil($\log_2$(P)) samples, where ceil(x) is the integer greater than or equal to x;

calculating the Fourier transform of the second segment; and after determination of the spectral components, identifying the frequencies associated with the components, and constructing the synthesized signal by resampling with modification of said frequencies as a function of the resampling;

c) synthesizing at least one replacement frame for the lost frame, by construction of a synthesized signal from at least a portion of the spectral components, said synthesized signal having a plurality of said spectral components.

2. The method according to claim 1, further comprising searching by correlation in said valid signal, for one repetition period, wherein the length of the segment comprises at least one repetition period.

3. The method according to claim 2, wherein the repetition period corresponds to a length for which the correlation exceeds a preset threshold value.

4. The method according to claim 1, further comprising determining respective phases associated with the spectral components and wherein the construction of the synthesized signal then comprises said phases of the spectral components.

5. The method according to claim 1, further comprising determining respective amplitudes associated with the spectral components and wherein the construction of the synthesized signal then comprises said amplitudes of the spectral components.

6. The method according to claim 1, further comprising determining respective amplitudes associated with the spectral components and wherein a highest amplitude spectral components are selected for the construction of the synthesized signal.

7. The method according to claim 1, further comprising adding noise to the synthesized signal in order to compensate for a loss of energy relative to spectral components not selected for construction of the synthesized signal.

8. The method according to claim 7, wherein the aforementioned noise is obtained by a weighted residue between the signal from the segment and the synthesized signal.

9. The method according to claim 1, applied in a context of decoding by transform with recovery, wherein the synthesized signal is constructed over at least two frame lengths.

10. The method according to claim 1, applied in a context of decoding by transform with recovery, wherein the synthesized signal is constructed over at least two frame length, and wherein the synthesized signal is constructed over two frame lengths and an additional length corresponding to a delay introduced by a resampling filter.

11. The method according to claim 1, further comprising separating a signal coming from said valid frame into a high-frequency band and a low-frequency band and wherein the spectral components are selected in the low-frequency band.

12. The method according to claim 11, wherein the replacement frame is synthesized by an addition of:

a first signal constructed from spectral components selected in the low-frequency band, and a second signal coming from the filtering in the high-frequency band, where the second signal is obtained by successively duplicating at least one valid half-frame and the temporally folded version thereof.

13. A non-transitory computer storage medium comprising instructions of a program for the implementation of the method as claimed in claim 1, when this program is executed by a processor.

14. A device for decoding a signal comprising a succession of samples distributed in successive frames, comprising a circuit and algorithms for replacing at least one lost signal frame, and:

a) searching, in a valid signal available to the decoder, for a signal segment of length corresponding to a period set as a function of said valid signal;

b) analyzing a spectrum of the segment in order to determine spectral components of the segment by carrying out steps comprising:

interpolating the samples from the segment in order to obtain a second segment comprising 2^ceil($\log_2$(P)) samples, where ceil(x) is the integer greater than or equal to x;

calculating the Fourier transform of the second segment; and after determination of the spectral components, identifying the frequencies associated with the components, and constructing the synthesized signal by resampling with modification of said frequencies as a function of the resampling;

c) synthesizing at least one replacement frame for the lost frame, by construction of a synthesized signal from at least a portion of the spectral components, said synthesized signal having a plurality of said spectral components.

* * * * *